United States Patent [19]

Beilis

[11] 4,359,887

[45] Nov. 23, 1982

[54] KEY PLATE AND HOOK ASSEMBLY

[76] Inventor: Aron Beilis, 116 Bowdoin St., Staten Island, N.Y. 10306

[21] Appl. No.: 217,208

[22] Filed: Dec. 17, 1980

[51] Int. Cl.[3] ..... A47G 29/10

[52] U.S. Cl. ..... 70/456 B

[58] Field of Search ..... 70/456 B, 456 R, 457, 70/458, 459; 150/40; 24/3 K

[56] References Cited

U.S. PATENT DOCUMENTS

| | | | |
|---|---|---|---|
| 2,407,153 | 9/1946 | Hanna | 70/456 B |
| 2,630,700 | 3/1953 | Boden | 70/456 B |
| 2,780,089 | 2/1957 | Duell | 70/456 B |
| 2,808,718 | 10/1957 | Legat | 70/456 B |
| 3,889,502 | 6/1975 | Kruger | 70/456 B |

*Primary Examiner*—Robert L. Wolfe

*Attorney, Agent, or Firm*—Eugene E. Geoffrey, Jr.

[57] ABSTRACT

A key plate and hook assembly having an elongated tubular housing with a plurality of transverse slots to carry and retain key hooks each having an enlarged end portion, the slots each have an enlarged central portion to permit removal of the hook. A locking member having a plurality of slots separated by transverse ribs is slidably disposed in the housing and in one position the ribs underlie the enlarged central portion to retain the hooks in position, and in another position permit the key hooks to be removed. The front wall of the housing has a concave central portion so that the key hooks will normally assume positions at one end or the other of the housing slots depending on the physical position of the housing.

8 Claims, 7 Drawing Figures

KEY PLATE AND HOOK ASSEMBLY

This invention relates to a key plate and hook assembly for use in key cases and the like and more specifically to a key plate embodying means for readily engaging and disengaging the key hooks and which is characterized by its simplicity, ease of operation and reliability.

A wide variety of key plates have heretofore been produced embodying means for attaching and detaching selected hooks. In known key plates having means for readily removing the key hooks, either individual spring means are provided to retain each hook in place or more convenient single means are provided to open all key hook slots with the result that one or more key hooks may be accidentally disengaged when it is desired to remove only certain key hooks. Furthermore, known devices are relatively complicated to manufacture and assemble.

This invention overcomes the aforementioned difficulties with known devices and provides a novel and improved key plate and hook assembly embodying a sturdy durable structure which can be manufactured and assembled at relatively low cost.

Another object of the invention resides in the provision of a novel and improved key plate accommodating a plurality of key hooks and having a novel arrangement and organization of elements which facilitates selective removal of said key hooks while minimizing accidental disengagement of other key hooks.

The key plate and hook assembly in accordance with the invention includes an elongated hollow rectangular housing having a concave outer wall portion and a plurality of transverse slots with a recess disposed centrally in one side edge of each slot, a slidable member within said housing having a body portion engaging the walls of said housing, an elongated U-shaped element carried by said body portion and having a plurality of transverse slots forming a plurality of ribs for coordination with the first said slots, spring means holding the body portion in one position with the ribs of the U-shaped member positioned to underlie said recesses and in another position to open said recesses to permit removal of a key hook carried in one of the slots in said body portion.

The above and other objects and advantages of the invention will become more apparent from the following description and accompanying drawings forming part of this application.

IN THE DRAWINGS

Figures 1, 2, 3, 4, 5, 6, 7:
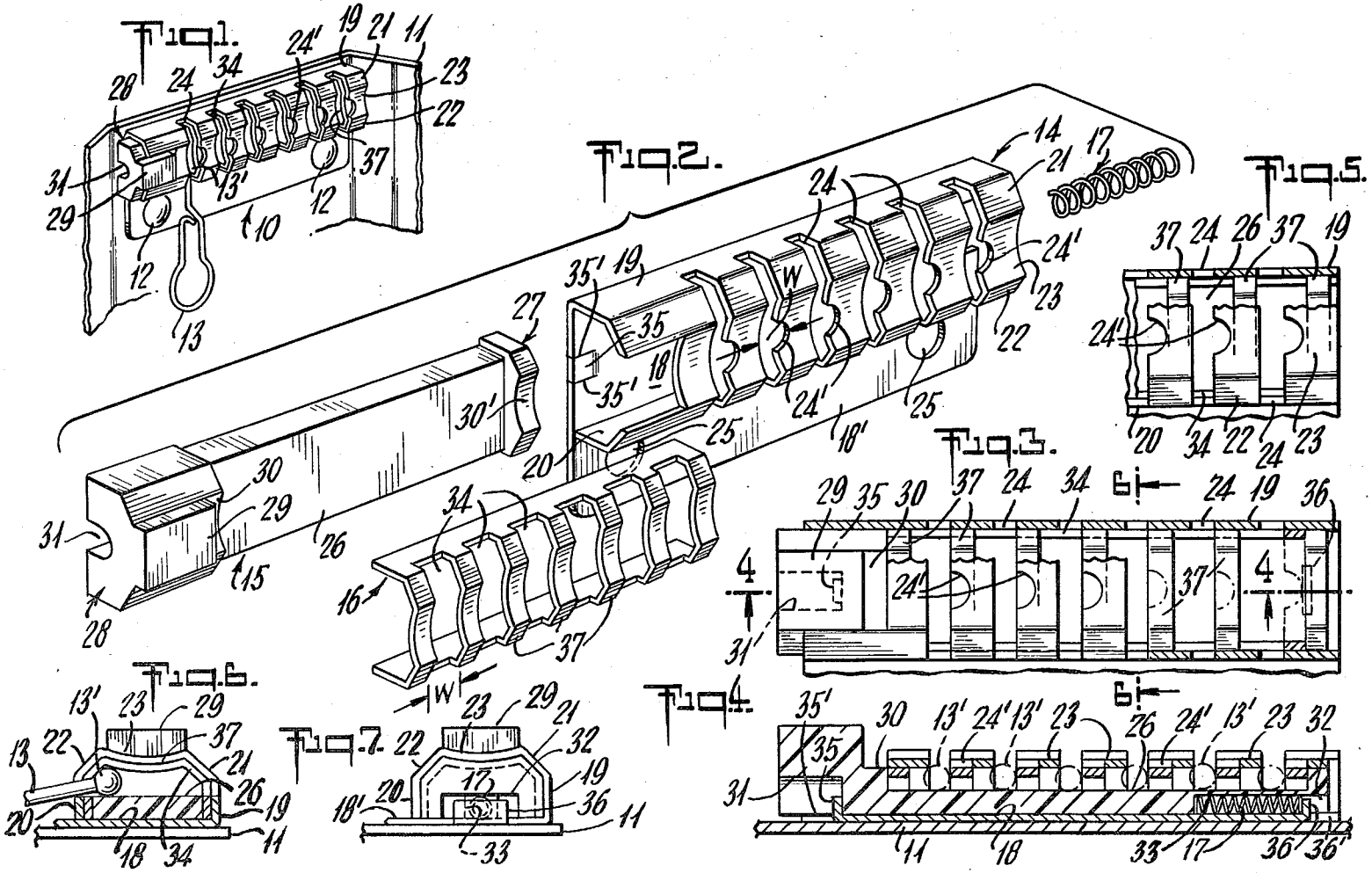
FIG. 1 is a perspective view of the key plate hook assembly in accordance with the invention and mounted in a key case.
FIG. 2 is an exploded view of the key plate illustrated in FIG. 1.
FIG. 3 is a front elevational view in partial section of the key plate shown in FIG. 1.
FIG. 4 is a cross sectional view of FIG. 3 taken along the line 4—4 thereof.
FIG. 5 is a fragmentary portion of the structure shown in FIG. 3 with the elements positioned to permit release of key hooks.
FIG. 6 is a cross sectional view of FIG. 3 taken along the line 6—6 thereof.
FIG. 7 is a right hand end view of FIG. 4 taken in the direction of the line 7—7 thereof.

The key plate and hook assembly in accordance with the invention is denoted in FIG. 1 by the numeral 10 and is secured in position within the key case 11 by a pair of rivots 12 or other suitable fastening means. In the instant embodiment of the invention, the key plate is arranged for the reception of six hooks 13 though it will become evident as the description proceeds that the key plate 10 can be arranged to accommodate any number of hooks 13.

Referring now to FIG. 2, the key plate 10 comprises four essential elements namely an elongated hollow housing 14, a body 15 which slidably engages the housing 14, a generally U-shaped locking element 16 which is carried by the body 15 and functions in one position to retain the key hooks in position on the key plate and in another position to permit key hooks to be removed from the key plate and a spring 17 which urges the body 15 and the body 15 and locking element 16 into a normal locking position.

The housing 14, which may be formed of any suitable material, though metals such as steel or aluminum may be preferred, is of unitary construction and includes a back plate 18, upper and lower walls 19 and 20 and a front wall consisting of upper and lower inclined portions 21 and 22 connected by a concave portion 23. A plurality of slots 24 are formed in the front wall portions 21, 22 and 23 and extend a short distance into the side walls 19 and 20 and each of the slots has a semi-circular recess 24' in one edge thereof which, as will be pointed out, facilitates release of the key hooks 13. The left end of the concave front wall portion 23 terminates at a point spaced from the left hand edge of the housing 14 to accommodate a portion of the body 15 which will function to limit motion of the body portion 15 to the right as illustrated in the drawings. It will be observed that the rear wall 18 of the housing has a portion 18' extending below the bottom wall 20 and includes a pair of openings 25 to accommodate the rivots 12 as illustrated in FIG. 1.

The body 15 as pointed out above slidably engages the housing 14 and includes an elongated rectangular portion 26, a relatively narrow right end portion 27 and a relatively wide left hand portion 28. As will become evident, the body 15 may be formed in any desired manner and of any desired material. By reason of its configuration, it is susceptible of formation of metals or plastics and either molded, die-cast or machined as may be desired. The right hand portion 27 of the body has a configuration corresponding to the internal configuration of the housing and the left hand portion 28 has a similar configuration with the exception of a rectangular projection 29 extending over a portion of the length of the member 28, the member 28 terminating forwardly of the rectangular portion in a concave portion 30 to conform with the concave portion 23 of the housing. It will also be observed that the back or underside of the body 15 is provided with a groove or recess 31 at the left hand portion and a relatively wide groove or recess 32 at the right hand portion which communicates with a narrower groove 33 to accommodate the spring 17 as will be observed more clearly in FIG. 4.

The locking element 16 of U-shaped configuration is adapted to be carried by the rectangular portion 26 of the body 15 with the ends of the locking element 16 abutting the inner surfaces of the end portions 27 and 28 of the body. The cross sectional configuration of the locking element 16 coordinates precisely with the cross sectional configuration of the body end portions 27 and 28 which in turn conform with the inner cross section of the housing 14. When the locking element 16 is in position on the body 15 and the body is positioned within the housing 14, the locking element is securely retained on the body.

The locking element 16 is further provided with a plurality of relatively wide slots 34 with each slot having a width W which corresponds to the width W on the housing 14 which is the distance between the left hand edge of the slot 24 and the deepest portion of the recess 24'. The radius of each recess 24' is coordinated with the diameter of the ball 13' on the upper end of each key hook 13 as will be described.

The body portion 15 together with the locking element 16 is retained within the housing 14 by means of a pair of tabs 35 and 36 formed by slitting back wall 18 of the housing 14 along the lines 35' and 36' as illustrated more clearly in FIGS. 2, 4 and 7. While assembly may be accomplished in any desirable manner, the tab 36 may be bent upwardly as illustrated in FIGS. 4 and 7. This tab has a width slightly less than the recessed portion 32 in the bottom of the body 15 as previously described. The spring 17 is then placed within the recess 33 in the bottom of the body and the body together with the locking plate 16 is then placed in position within the housing 14. Then with the body completely within the housing and the spring 17 compressed, the tab 35 may be bent upwardly as illustrated in FIG. 6 to retain the body and locking element within the housing 14. After the tab 35 has been bent upwardly, the body 15 is released and will move to the left as illustrated in the drawings and specifically FIGS. 3 and 4. In these figures, it will be observed that the right edge 34' of each of the slots 34 is coincident with the right edge of each of the slots 24 with the result that the metal strips 37 which function to separate the slots 34 each underlie one of the recesses 24' in the housing. In this position, the balls 13' on the end of the key holders are entrapped and securely retain the key holders in position on the key plate.

It will be observed, with particular reference to FIG. 3, that when the body 15 is in the normal position with the spring 17 expanded to its maximum length, that the body extends beyond the left end of the housing a distance D which is approximately equal to the depth of each of the recesses 24' in the housing 14. With this arrangement and upon displacement of the body to the right as viewed in FIG. 3, the spacing elements 37 will move to the right and thus in effect open the recesses 24'. In this position, one or more of the key holders 13 can be removed since the ball 13' on each key holder is slightly smaller in diameter than the distance between the left hand edge of each slot on the body 14 and the deepest portion of the recess 24' on the body 15. Displacement of the body to the right as shown in the drawings is limited by engagement of the right hand edge of the rectangular portion 29 with the housing in order to properly align the components for removal of key hooks.

The diameter of the balls 13' on each key hook 13 is selected as illustrated in FIGS. 4 and 6 so that when the body 15 is in a normal leftward position as illustrated in FIGS. 3 and 4, the balls 13' will be retained by the left edge of each of the slots 24' and the left hand edge of the adjoining spacer or rib 37 forming part of the locking element 16 which lies just to the right of the ball. With this arrangement, the balls will be retained within the slots 24' of the housing 14 and can move within the slots. Through the utilization of the concave front wall portion 23 in the housing 14, the balls will tend to assume the positions at one end or the other of the slots depending on the position of the hook 13 and cannot normally become disengaged when the body 15 is moved to the right as previously described in order to open the recesses 24' to permit removal of the key hooks. Therefore, one or more selected keys can be removed readily without the danger of other key hooks becoming accidentally disengaged. It is also to be observed that the concave portion 23 on the housing 14 serves the additional function of strengthening the key plate structure and prevents accidental deformation of the structure which may adversely affect its operation.

While only one embodiment of the invention has been illustrated and described, it is understood that alterations, changes and modifications may be made without departing from the true scope and spirit thereof.

What is claimed is:

1. A key plate and hook assembly comprising an elongated tubular housing having front, rear, upper and lower walls and a plurality of transverse slots in said front wall and extending partially into said upper and lower walls with each slot having a recess in one edge thereof, a body member having a rear wall, end portions of a cross sectional configuration corresponding to the internal cross sectional configuration of said tubular housing and an intervening connecting portion, a U-shaped locking member carried by said connecting portion and forming with said connecting portion a cross sectional configuration corresponding to the configuration of said end portions, said U-shaped locking member having a plurality of transverse slots having spacings corresponding to the spacings of the first said slots, the last said slots being separated by intervening ribs and means slidably retaining said body and U-shaped member within said body whereby key hooks each having an enlarged end portion are normally held in engagement with the slots in said key plate when said locking member is in one position with said ribs underlying said recesses and are removably when said locking member is moved to another position to displace said ribs and open said recesses and permit disengagement of said key hooks.

2. A key plate and hook assembly according to claim 1 wherein the rear wall of said body includes recesses adjoining the ends thereof and the rear wall of said housing includes inwardly formed tabs engaging the last said recesses to retain said body and locking member within said housing.

3. A key plate and hook assembly according to claim 2 including a spring in one of said recesses and reacting between said body and one of said tabs to urge said body into said one position, said body being movable against the action of said spring to said other position.

4. A key plate and hook assembly according to claim 1 wherein said front wall includes upper and lower portions inclined inwardly and a concave portion integrally joined to the inner edges of said inclined portions thus providing a relatively rigid structure with said concave front wall portion causing said key hooks to normally assume positions at the edges of said slots and thereby minimize accidental disengagement of key hooks when only selected key hooks are to be removed.

5. A key plate and hook assembly according to claim 4 wherein the concave front wall portion of said housing terminates at a point spaced fron one end of said housing to provide a slot between said inclined wall portions and one end portion of said body includes a raised portion disposed in the last said slot whereby said raised portion limits displacement of said body to said other position.

6. A key plate and hook assembly according to claim 5 wherein the rear wall of said body includes recesses adjoining the ends thereof and the rear wall of said housing includes inwardly formed tabs engaging the last said recesses to retain said body and locking member within said housing.

7. A key plate and hook assembly according to claim 6 including a spring in one of said recesses and reacting between said body and one of said tabs to urge said body into said one position, said body being movable against the action of said spring to said other position.

8. A key plate and hook assembly comprising an elongated tubular housing having a plurality of transverse slots therein to carry and retain key hooks, the latter having an enlarged end portion retained by said slots, each of said slots having an enlarged central portion to permit removal of said hooks, means slidably disposed within said housing and movable from one position closing said enlarged portions and retaining said key hooks in said slots to another position permitting removal of said key hooks through said enlarged portions, said housing further having a front wall comprising upper and lower inclined portions and an intervening concave portion whereby said key hooks will normally assume positions at one edge or the other of said slots thus facilitating removal of selected key hooks through said enlarged slot portions when said slidable means is disposed in said other position.

* * * * *